US008839484B2

(12) United States Patent
Krebs

(10) Patent No.: US 8,839,484 B2
(45) Date of Patent: Sep. 23, 2014

(54) VACUUM CLEANER BASE WITH AGITATOR DRIVE ASSEMBLY

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 722 days.

(21) Appl. No.: 13/080,952

(22) Filed: Apr. 6, 2011

(65) Prior Publication Data

US 2011/0179596 A1 Jul. 28, 2011

Related U.S. Application Data

(63) Continuation-in-part of application No. 11/813,832, filed on Jul. 12, 2007, now abandoned, which is a continuation of application No. PCT/US2006/026696, filed on Jul. 11, 2006.

(60) Provisional application No. 60/595,515, filed on Jul. 12, 2005.

(51) Int. Cl.

| | |
|---|---|
| ***A47L 5/00*** | (2006.01) |
| ***A47L 9/06*** | (2006.01) |
| ***A47L 5/30*** | (2006.01) |
| ***A47L 9/04*** | (2006.01) |

(52) U.S. Cl.

CPC .. *A47L 9/045* (2013.01); *A47L 5/30* (2013.01)
USPC ..... 15/389; 15/390

(58) Field of Classification Search

USPC ..... 15/390, 389
See application file for complete search history.

(56) References Cited

U.S. PATENT DOCUMENTS

| | | | | |
|---|---|---|---|---|
| 1,294,468 | A * | 2/1919 | Hunsicker | 15/390 |
| 1,333,677 | A * | 3/1920 | Rauch | 15/355 |
| 1,448,349 | A * | 3/1923 | Hoover | 15/390 |
| 1,460,245 | A * | 6/1923 | Hoover | 15/376 |
| 1,540,099 | A | 6/1925 | Boyer | |
| 2,094,138 | A | 9/1937 | White | |
| 2,250,282 | A * | 7/1941 | Swann | 15/332 |
| 2,601,698 | A | 7/1952 | Humphrey | |
| 4,686,736 | A | 8/1987 | Petralia et al. | |
| 5,537,712 | A * | 7/1996 | Weber et al. | 15/391 |
| 6,067,689 | A | 5/2000 | Roney et al. | |
| 6,098,243 | A | 8/2000 | Kim | |
| 2002/0124346 | A1 * | 9/2002 | Steiner et al. | 15/384 |
| 2003/0196294 | A1 | 10/2003 | Conrad | |
| 2004/0200031 | A1 | 10/2004 | Park | |
| 2005/0022339 | A1 * | 2/2005 | Hafling et al. | 15/415.1 |
| 2007/0283522 | A1 | 12/2007 | Choi et al. | |

FOREIGN PATENT DOCUMENTS

| | | | |
|---|---|---|---|
| WO | 2007008771 | A2 | 1/2007 |

* cited by examiner

*Primary Examiner* — Bryan R Muller
(74) *Attorney, Agent, or Firm* — McGarry Bair PC

(57) ABSTRACT

An upright vacuum cleaner comprises a base assembly pivotally connected to an upright assembly. The base assembly comprises an agitator and an agitator drive assembly for selectively driving the agitator. The agitator drive assembly includes a drive disk coupled to a motor shaft, a driven disk which engages the drive disk, and a drive coupling between the driven disk to the agitator. The agitator drive assembly can further include a drive disengager for selectively interrupting the transmission of drive force to the agitator. The agitator drive assembly can further include a speed selector for adjusting the relative speed of rotation of the agitator.

20 Claims, 11 Drawing Sheets

VACUUM CLEANER BASE WITH AGITATOR DRIVE ASSEMBLY

CROSS REFERENCE TO RELATED APPLICATIONS

This application is a continuation-in-part of U.S. patent application Ser. No. 11/813,832, filed Jul. 12, 2007, now abandoned, which is a continuation of International Application No. PCT/US2006/026696, filed Jul. 11, 2006, which claims the benefit of U.S. Provisional Patent Application No. 60/595,515, filed Jul. 12, 2005, all of which are incorporated herein by reference in their entirety.

BACKGROUND OF THE INVENTION

Upright vacuum cleaners employing cyclone separators are well known. Some cyclone separators follow textbook examples using frusto-conical shape separators and others use high-speed rotational motion of the air/dirt to separate the dirt by centrifugal force. Typically, working air enters and exits at an upper portion of the cyclone separator as the bottom portion of the cyclone separator is used to collect debris. Furthermore, in an effort to reduce weight, the motor/fan assembly that creates the working air flow is typically placed at the bottom of the handle, below the cyclone separator.

BISSELL Homecare, Inc. presently manufactures and sells in the United States an upright vacuum cleaner that has a cyclone separator and a dirt cup. A horizontal plate separates the cyclone separator from the dirt cup. The air flowing through the cyclone separator passes through an annular cylindrical cage with baffles and through a cylindrical filter before exiting the cyclone separator at the upper end thereof. The dirt cup and the cyclone separator are further disclosed in the U.S. Pat. No. 6,810,557, which is incorporated herein by reference in its entirety.

U.S. Pat. No. 4,571,772 to Dyson discloses an upright vacuum cleaner employing a two stage cyclone separator. The first stage is a single separator wherein the outlet of the single separator is in series with an inlet to a second stage frusto-conical separator.

SUMMARY OF THE INVENTION

According to the invention, a vacuum cleaner comprises a base assembly having a housing, a suction nozzle, and an agitator rotatably mounted to the housing, a motor comprising a motor shaft, and an agitator drive assembly between the motor shaft and the agitator for selectively driving the agitator. The agitator drive assembly comprises a drive disk mounted to the motor shaft for rotation about a rotational axis and having a face in a plane perpendicular to the rotational axis, an actuator for selectively uncoupling the agitator drive assembly, a driven disk rotatably coupled to the actuator for movement therewith and selectively coupled with the drive disk for rotational contact with the face of the drive disk, and a drive coupling between the driven disk and the agitator, wherein the driven disk is laterally movable across the face of the drive disk to change the relative speed of the agitator.

DESCRIPTION OF THE PREFERRED EMBODIMENT

The invention relates to suction cleaners, and in particular, to the base portion of an upright vacuum cleaner. More specifically, the invention relates to an agitator drive assembly which can be selectively disengaged to interrupt the transmission of driving force to an agitator.

Figure 1:
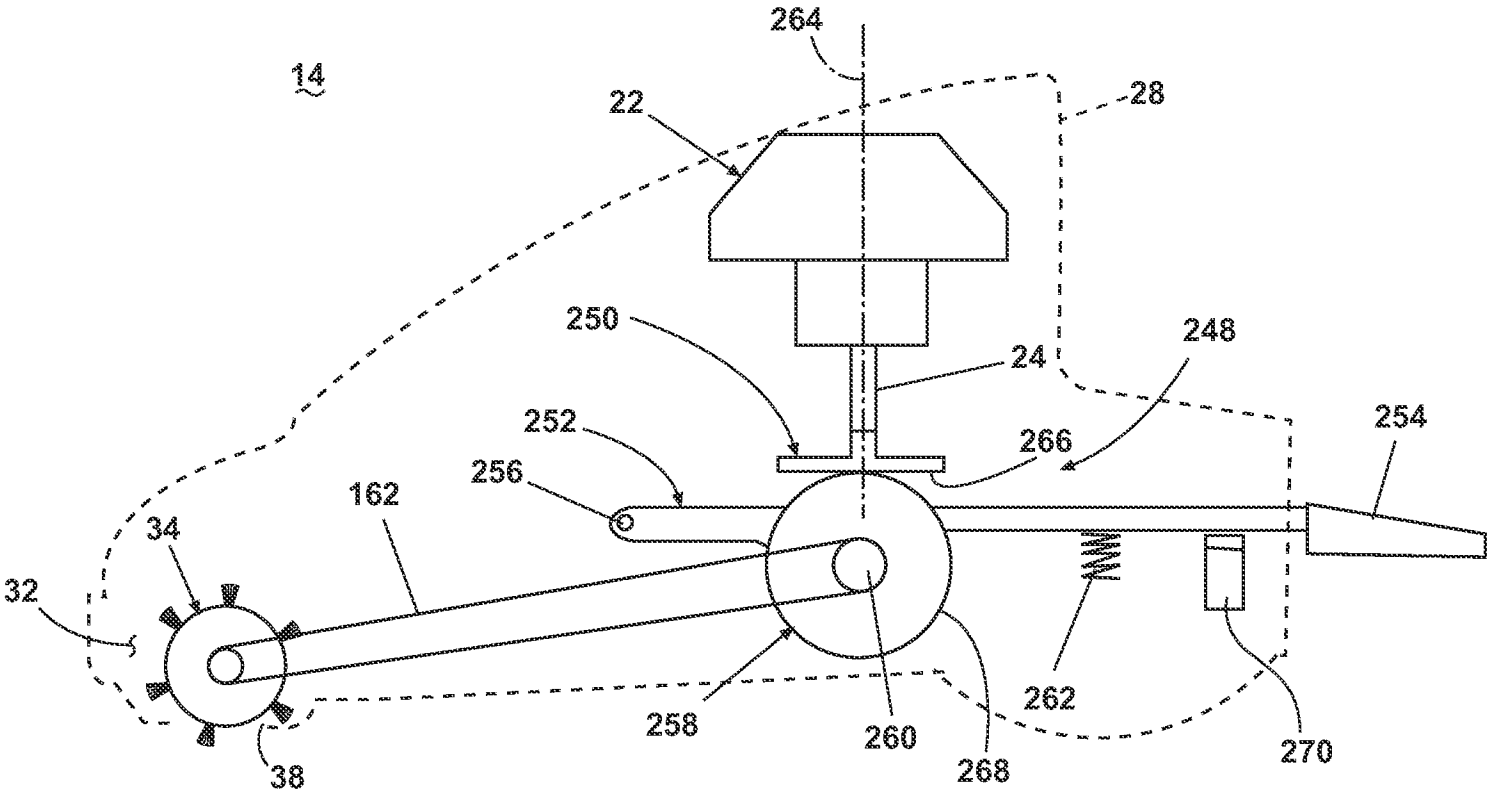
FIG. 1 is a schematic view of a base assembly for a vacuum cleaner according to a first embodiment of the invention, the base assembly having an agitator drive assembly shown in an engaged position.

A base assembly 14 for a vacuum cleaner according to a first embodiment of the invention is shown in FIG. 1. The base assembly 14 can be pivotally mounted to an upright handle assembly (not shown) which includes a dirt separation/collection assembly as is commonly known in the art. A suitable vacuum cleaner structure is shown and described in more detail in U.S. patent application Ser. No. 11/813,832, filed Jul. 12, 2007 and published as U.S. Patent Application Publication No. 2008/0216823 on Sep. 11, 2008, which is incorporated herein by reference in its entirety.

The base assembly 14 comprises a housing 28 having an agitator chamber 32 at a forward portion thereof for containing a rotatably-mounted agitator 34. The agitator 34 can comprise a brush roll. A suction nozzle 38 is provided on a lower side of the housing, adjacent the agitator chamber. Wheels (not shown) can be provided on the housing 28 for facilitating movement of the base assembly 14 over a surface to be cleaned.

A drive coupling, shown herein as a belt 162, couples the agitator 34 to a drive source. Alternatively, some non-limiting examples of drive couplings can comprise a gear train or a friction drive train. As shown herein, the drive source is a source of suction, such as motor/fan assembly 22, provided in the base assembly 14. The motor/fan assembly 22 can serve as a source of suction for the vacuum cleaner as well as the drive source. Alternatively, the motor/fan assembly 22 can be dedicated solely to driving the agitator 34, and a separate source of suction can be provided within the vacuum cleaner. The motor/fan assembly 22 can include a motor shaft 24 extending from the motor (not shown). As shown, the motor/fan assembly 22 is fixedly mounted vertically in the base assembly 14, such that the the motor shaft 24 extends normally with respect to a surface being cleaned.

The base assembly 14 is provided with an agitator drive assembly 248 for selectively driving the agitator 34. A generally circular drive disk, such as a flywheel 250 is fixedly attached to and rotates with the motor shaft 24 about a rotational axis 264. The flywheel 250 includes a face 266 in a plane perpendicular to the rotational axis 264. A drive engaging arm 252 is pivotally attached to the housing 28 and comprises a foot pedal 254 on one end and a pivot point 256 on the other end. A driven or clutch disk, such as a belt drive hub 258, is rotatably mounted to the drive engaging arm 252, orthogonally to the flywheel 250, for selective engagement therewith. The belt 162 is in mechanical communication with a drive hub shaft 260 extending from the drive hub 258 and the agitator 34. The drive engaging arm 252 is biased by a drive engaging spring 262 to place the belt drive hub 258 in selective contact with the flywheel 250.

The agitator drive assembly 248 can be configured to selectively interrupt the transmission of drive force to the agitator 34. The foot pedal 254 can be used to move the agitator drive assembly 248 from an engaged position shown in FIG. 1 in which the belt drive hub 258 engages the face 266 of the flywheel 250, to a disengaged position shown in FIG. 2, in which the belt drive hub 258 is spaced from the face 266 of the flywheel 250.

In operation, the motor shaft 24 rotates when power is applied to the motor/fan assembly 22, causing the flywheel 250 to rotate. With the agitator drive assembly 248 in the engaged position shown in FIG. 1, the drive engaging spring 262 forces the drive engaging arm 252 to pivot about the pivot point 256 causing the belt drive hub 258 to engage the face 266 of the flywheel 250. As illustrated, a circumferential edge 268 of the belt drive hub 258 may couple with the face 266 for rolling contact therewith. The belt drive hub 258 rotates, which in turn causes the drive hub shaft 260 to rotate, rotating the belt 162 and ultimately the agitator 34.

Figure 2:
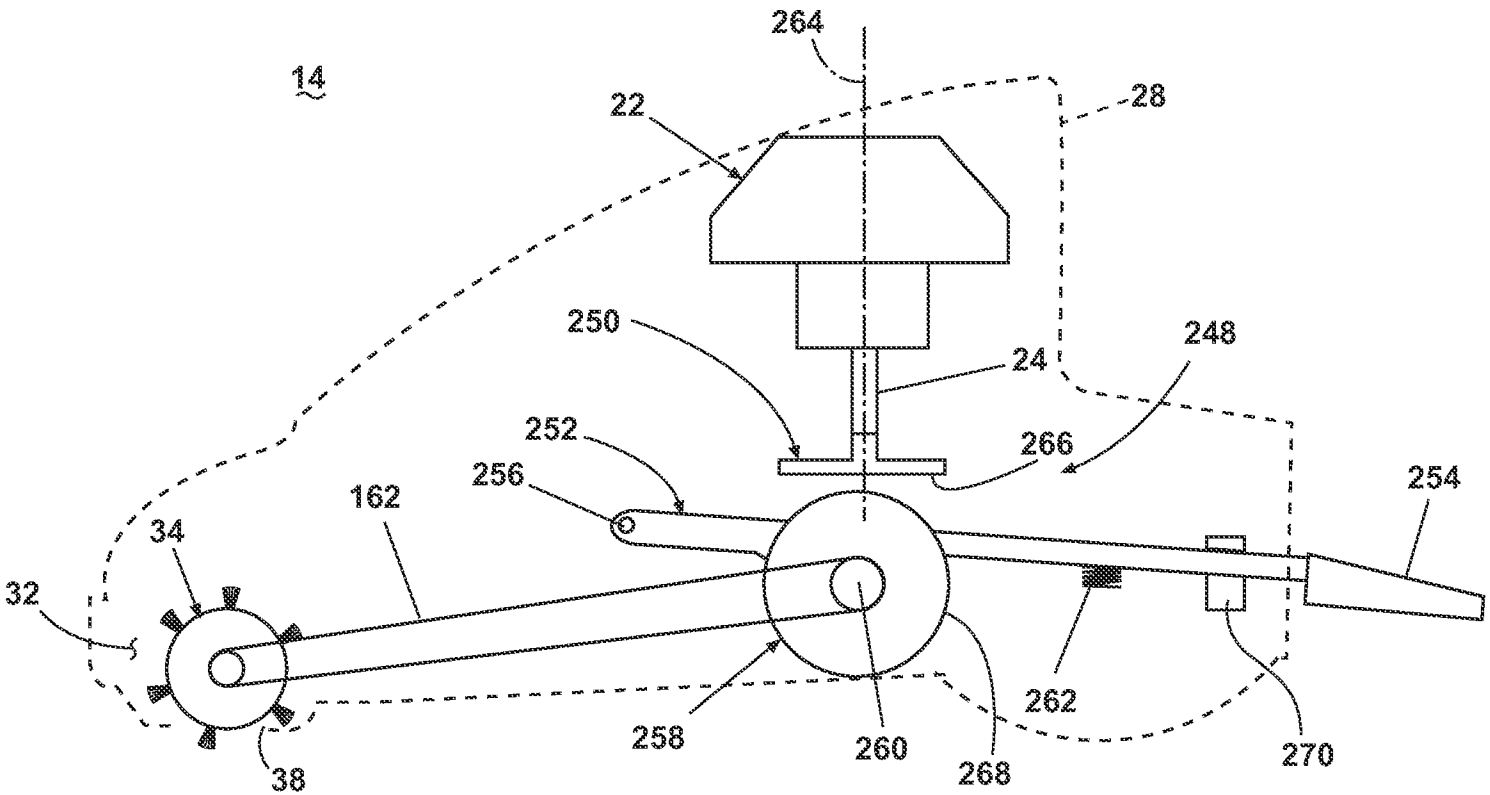
FIG. 2 is a schematic view of the base assembly from FIG. 1, with the agitator drive assembly shown in a disengaged position.

Pressing downwardly on the foot pedal 254 to place the agitator drive assembly 248 in the disengaged position shown in FIG. 2 causes the drive engaging arm 252 to pivot within the housing 28 about the pivot point 256. This moves the belt drive hub 258 downwardly relative to the flywheel 250 and out of contact with the face 266 of the flywheel 250. A commonly known latch 270 can be incorporated to secure the drive engaging arm 252 away from the flywheel 250 when the user steps on the foot pedal 254, effectively disengaging the brush drive mechanism when the user desires to use the vacuum cleaner 10 without the aid of the rotating agitator 34.

The agitator drive assembly 248 can further comprise a speed controller for adjusting the relative speed of rotation of the agitator 34. As can be appreciated, the drive engaging arm 252 can also pivot laterally so that the belt drive hub 258 can change contact positions on the flywheel 250. For example, when the belt drive hub 258 is positioned near the center of the flywheel 250, the belt drive hub 258 will rotate relatively slowly. As the belt drive hub 258 is moved toward the outer perimeter of the flywheel 250 the speed of the belt drive hub 258, and correspondingly the speed of the brush roll assembly 34, increases thus providing a variable speed brush control. The agitator drive assembly 248 can be configured to have a limited number of discrete positions for the belt drive hub 258 relative to the flywheel 250, thereby providing discretely-adjustable speed control. Alternatively, the agitator drive assembly 248 can be configured to place the belt drive hub 258 at any location between the center and outer perimeter of the flywheel 250, thereby providing infinitely-adjustable speed control between a maximum and minimum speed value.

Figure 3:
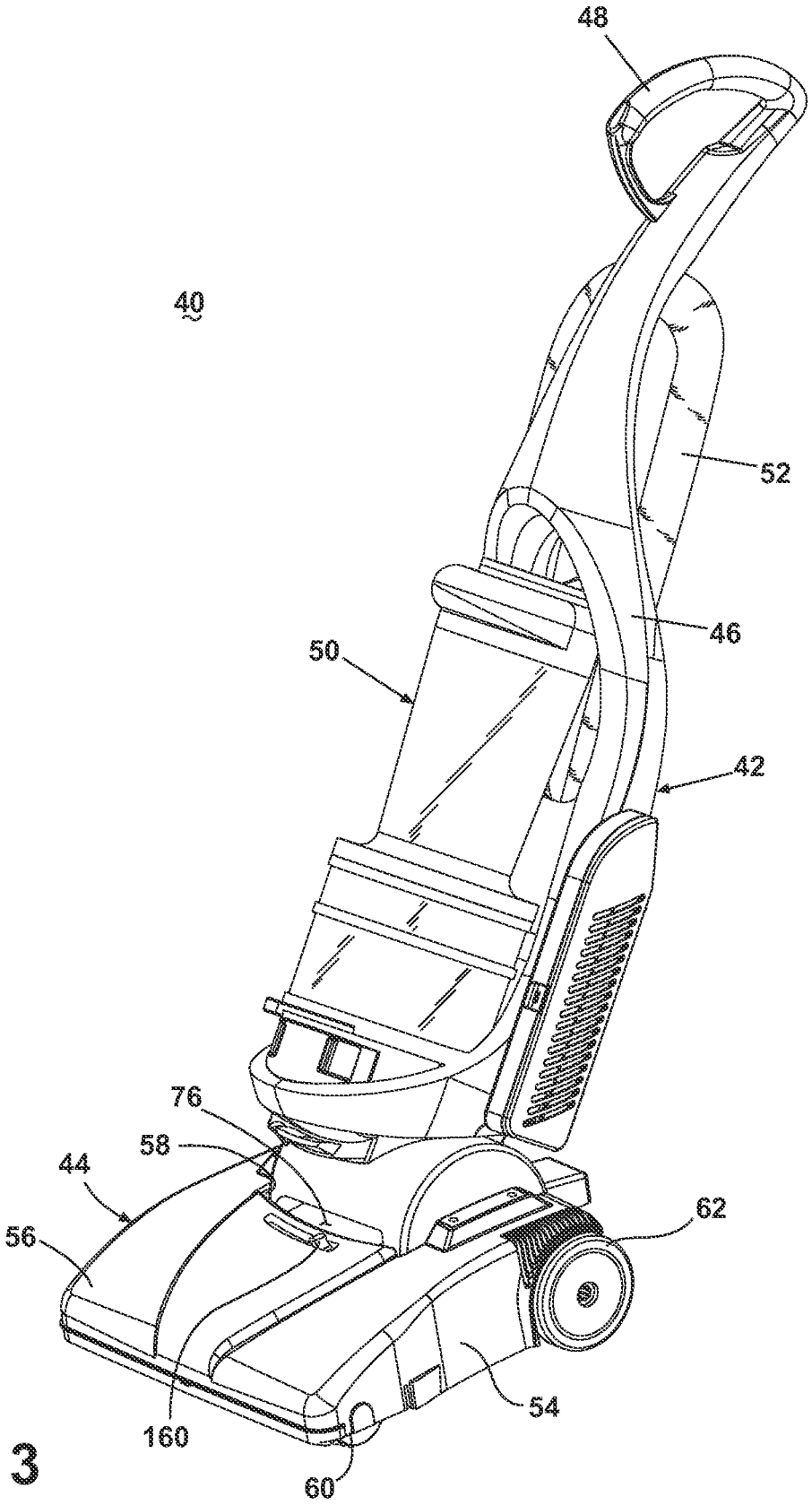
FIG. 3 is a perspective view of an upright vacuum cleaner according to a second embodiment of the invention, the vacuum cleaner having a base assembly pivotally mounted to an upright assembly.

FIG. 3 is a perspective view of an upright vacuum cleaner 40 according to a second embodiment of the invention. The vacuum cleaner comprises an upright assembly 42 pivotally mounted to a base assembly 44. The base assembly 44 may be similar to the first embodiment of the base assembly 14 shown in FIG. 1. The upright assembly 42 further comprises a primary support section 46 with a handle or grip 48 on one end to facilitate movement by the user. A source of suction can be provided in either the upright assembly 42 or the base assembly 44. The upright assembly 42 further receives a dirt separation and collection assembly, illustrated as a cyclone separation assembly 50 on the primary support section 46. The cyclone module assembly 50 forms part of a working air path fluidly connecting the base assembly 44 to the source of suction, and separates and collects debris from a working air stream for disposal after the cleaning operation is complete. The details of cyclone separators are known in the vacuum cleaner art and are not described in detail herein. A conventional vacuum hose 52 is also provided on the upright handle assembly 42 and is in fluid communication with the cyclone separation assembly 50 for above-the-floor cleaning purposes.

The base assembly 44 includes a housing 54 having an agitator chamber 56 at a forward portion thereof and a suction nozzle 60 is provided on a lower side of the housing 54, adjacent the agitator chamber 56. Wheels 62 are provided on the housing 54 for facilitating movement of the base assembly 44 over a surface to be cleaned. While not shown, the base assembly 44 can be provided with conduits necessary to establish a working air path from the suction nozzle 60 to the source of suction.

Figure 4:
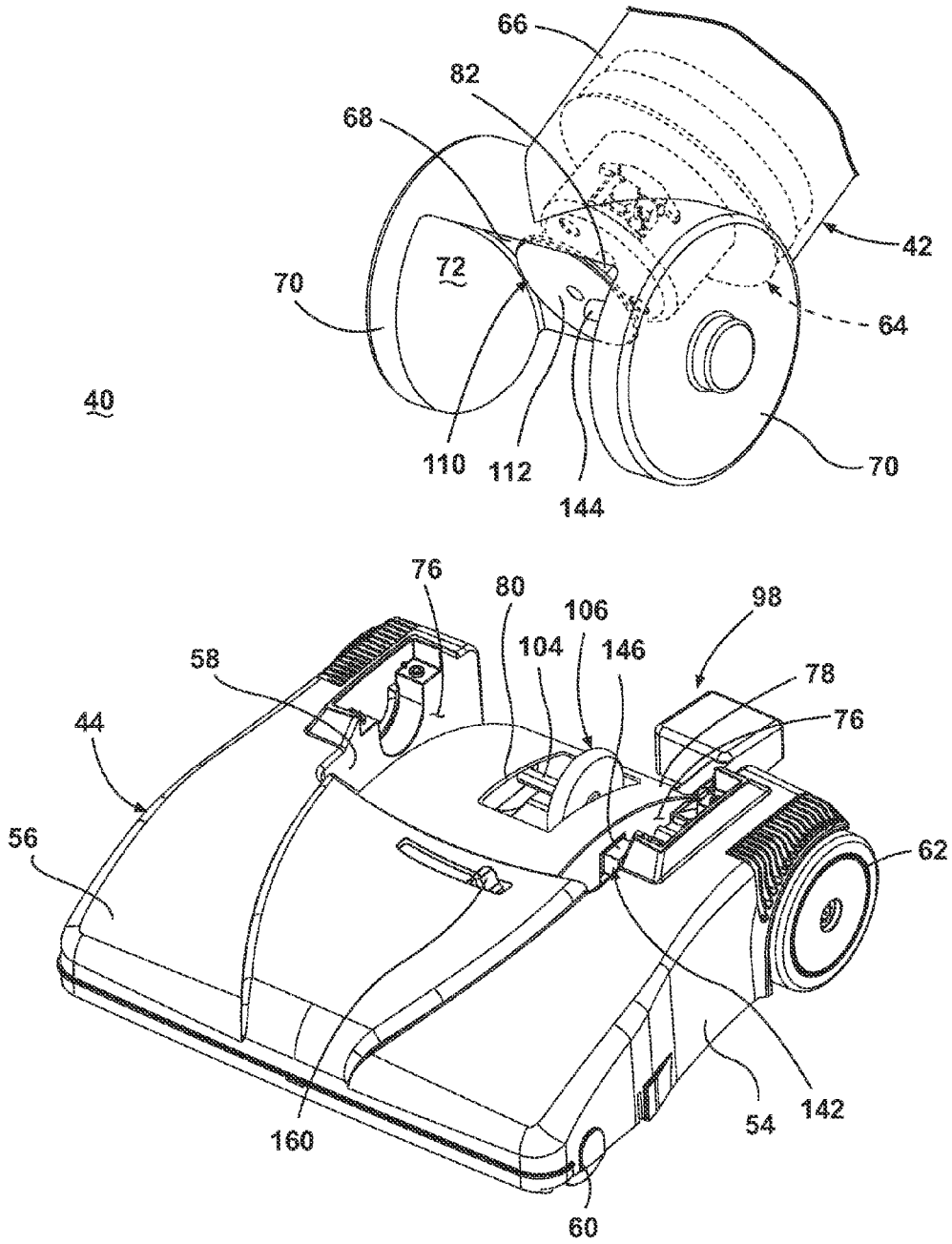
FIG. 4 is a partially exploded view of the vacuum cleaner from FIG. 3.

FIG. 4 is a partially exploded view of the vacuum cleaner 40 of FIG. 3. The vacuum cleaner 40 can be provided with a drive source comprising a motor/fan assembly 64 which can serve as a source of suction for the vacuum cleaner 40 as well as the drive source. Alternatively, the motor/fan assembly 64 can be dedicated solely to driving an agitator, and a separate source of suction can be provided within the vacuum cleaner 40. The motor/fan assembly 64 can be provided in either the upright assembly 42 or the base assembly 44. As shown herein, the motor/fan assembly 64 is provided in the upright assembly 42. The lower portion of the upright assembly 42 comprises a motor cavity 66 for containing the motor/fan assembly 64 and a lower surface 68 having a pair of spaced handle legs 70 extending therefrom that are pivotally mounted to the base assembly 44. The lower surface 68 and handle legs 70 together define a handle pivot cavity 72 in the upright assembly 42. An elongated slot 74 is provided in the lower surface 68. Alternatively, the vacuum cleaner can be provided with separate suction and drive sources.

The base assembly 44 comprises a pair of cut-out portions 76 on either side of a rear compartment 78 for housing components of the base assembly 44. The handle legs 70 are received within the cut-out portions 76 such that the handle pivot cavity 72 surrounds the rear compartment 78. The rear compartment 78 can be curved to permit close rotation of the upright assembly 42 relative to the base assembly 44. An elongated slot 80 is provided in the upper surface of the rear compartment 78.

The motor/fan assembly 64 can comprise a motor shaft 82 for transmitting torque and rotation. The motor/fan assembly 64 can be vertically oriented within the motor cavity 66, with the motor shaft 82 projecting exteriorly of the upright assembly 42 and coupled to a drive disk 100 that is oriented perpendicularly to the motor shaft 82 and is exposed between the handle legs 70, beneath the lower surface 68. The motor shaft 82 and associated drive disk 100 move relative to the base housing 54 as the upright assembly 42 pivots relative to the base assembly 14 from an upright or stored position and a lowered or use position.

Figure 5:
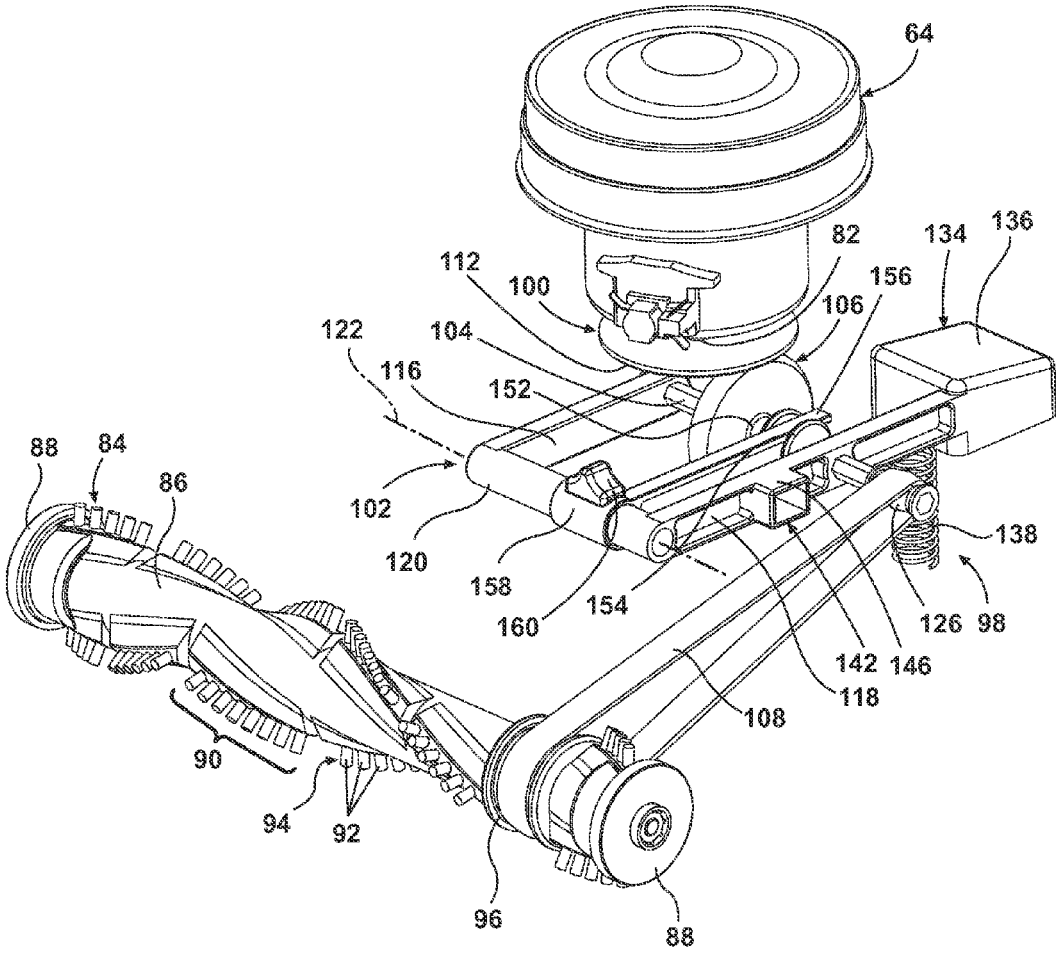
FIG. 5 is a perspective view of a lower portion of vacuum cleaner from FIG. 3, with housings of the base assembly and upright assembly removed for purposes of clarity.
Figure 6:
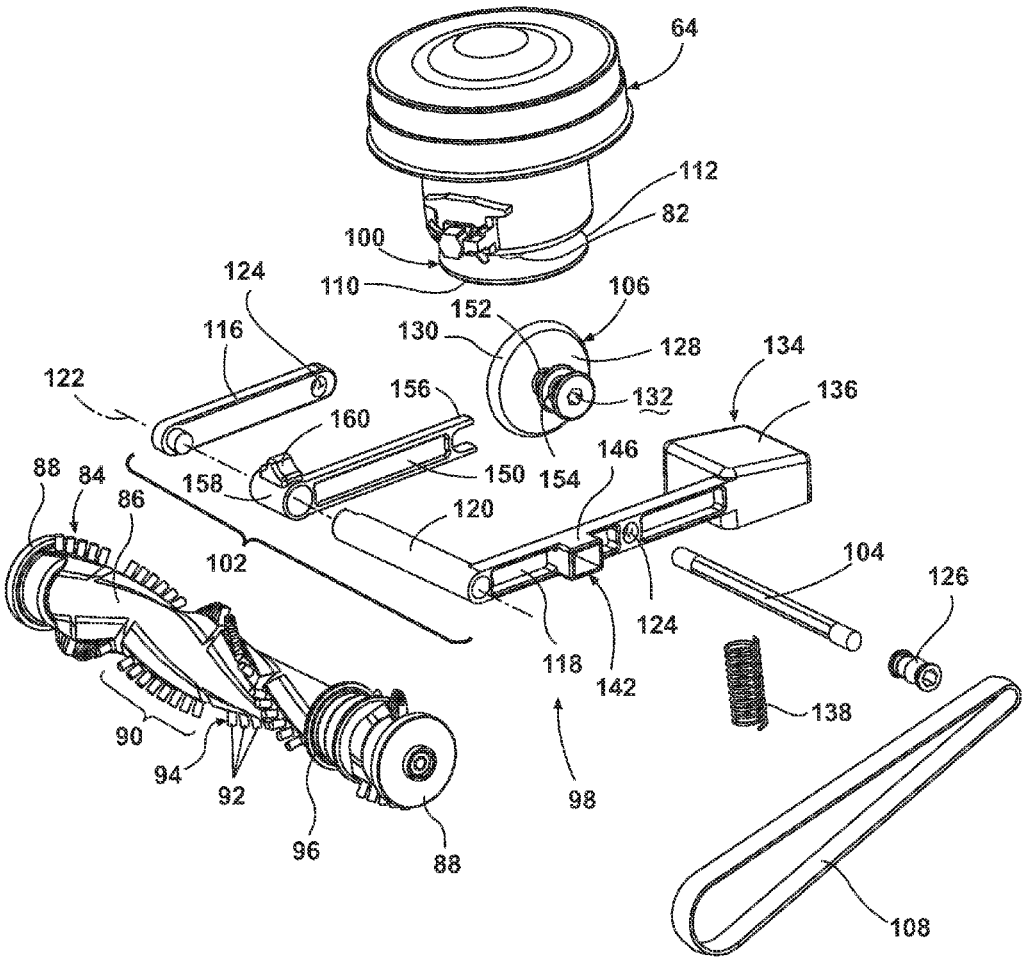
FIG. 6 is an exploded view of FIG. 5.

FIG. 5 is a perspective view of a lower portion of vacuum cleaner 40 from FIG. 3, with housings of the base assembly and upright assembly removed for purposes of clarity. An agitator 84 can be rotatably mounted within the agitator chamber 56. The agitator 84 can comprise a brush roll comprising a generally cylindrical brush dowel 86 with a bearing surface 88 on both ends which are mounted to the base housing 54 for permitting rotation of the brush dowel 86 relative to the base assembly 44. A plurality of flexible bristles 90 can extend from the outer circumference of the brush dowel 86, and can be provided in a plurality of individual tufts 92 arranged in one or more rows 94. As shown herein, the rows 94 of tufts 92 are arranged in a generally helical fashion around the brush dowel 86. A belt engagement surface 96 is provided around the circumference of the brush dowel 86 near one end thereof. The belt engagement surface 96 can comprise a driven pulley coupled with the agitator 84.

The base assembly 14 is provided with an agitator drive assembly 98 for selectively driving the agitator 84. The agitator drive assembly 98 comprises the drive disk 100 coupled to the motor shaft 82, a carriage 102 coupled to the base housing 54, a drive axle 104 rotatably coupled to the carriage 102, a driven or clutch disk 106 carried by the drive axle 104 and which engages the drive disk 100, and a drive coupling 108 between the clutch disk 106 and the agitator 84. As shown herein, the drive coupling 108 comprises a belt 108 operably coupling the drive axle 104 to the agitator 84. Alternatively, some other non-limiting examples of a suitable drive coupling 108 include a gear train comprising spur, worm, or bevel gears, or a friction drive train.

The drive disk 100 can comprise a wheel fixedly mounted on the motor shaft 82 for rotation there with. The drive disk 100 comprises a drive surface 110 which faces away from the motor/fan assembly 64 and an outer perimeter 112. The drive disk 100 is mounted to the motor shaft 82 at or near a center of the drive disk 100. The drive disk 100 can comprise a flywheel to store, via inertial momentum, rotational energy from the motor/fan assembly 64. The drive disk 100 can be configured to resist changes to its rotational speed, even as the intermittent load of the clutch disk 106 is increased. The drive surface 110 can be configured to frictionally drive the clutch disk 106. As such, at least the drive surface 110 of the drive disk 100 can be made of a material which will generate friction against the clutch disk 106, and possesses suitable anti-wear properties.

The carriage 102 comprises first and second spaced carriage arms 116, 118 and a pivot shaft 120 extending transversely between the arms 116, 118. As shown, the arms 116, 118 extend from opposite ends of the pivot shaft 120. The pivot shaft 120 can be rotatably mounted to the base housing 54 and can define a pivot axis 122 about which the carriage 102 rotates relative to the base housing 54.

The drive axle 104 extends between the first and second carriage arms 116, 118, and can rotate within openings 124 provided in each arm 116, 118 but restrained from lateral movement within the openings 124. A drive pulley 126 is mounted on an end of the drive axle 104 extending from the second arm 118. The belt 108 is received on the drive pulley 126 and on the belt engagement surface 96 of the agitator 84.

The clutch disk 106 comprises a wheel or hub 128 fixedly mounted on the drive axle 104 for rotation therewith. The clutch disk 106 includes a peripheral drive surface 130 that engages the drive surface 110 of the drive disk 100. A central opening 132 in the hub 128 receives the drive axle 104 and mounts the clutch disk 106 to the drive axle 104. The clutch disk 106 can be made from a single material; alternatively, the peripheral drive surface 130 can be made from a different material than the rest of the clutch disk 106. In either case, at least the peripheral drive surface 130 can be made of a material which will generate friction against the clutch disk 100, and possesses sufficient anti-wear properties. At least a portion of the wheel 128 may protrude through the slot 80 in the base housing 54, as shown in FIG. 4.

The drive axle 104 and clutch disk 106 can be provided with means for maintaining the angular relationship between them. As shown herein, the drive axle 104 comprises a hexagonal cross-section and the hub opening 132 comprises a corresponding hexagonal shape. Other configurations for the cross-section of the drive axle 104 and the opening 132 of the clutch disk 106 are possible. Alternatively, the means can comprise a spline or keyway-and-key coupling between the drive axle 104 and the clutch disk 106.

Figure 7:
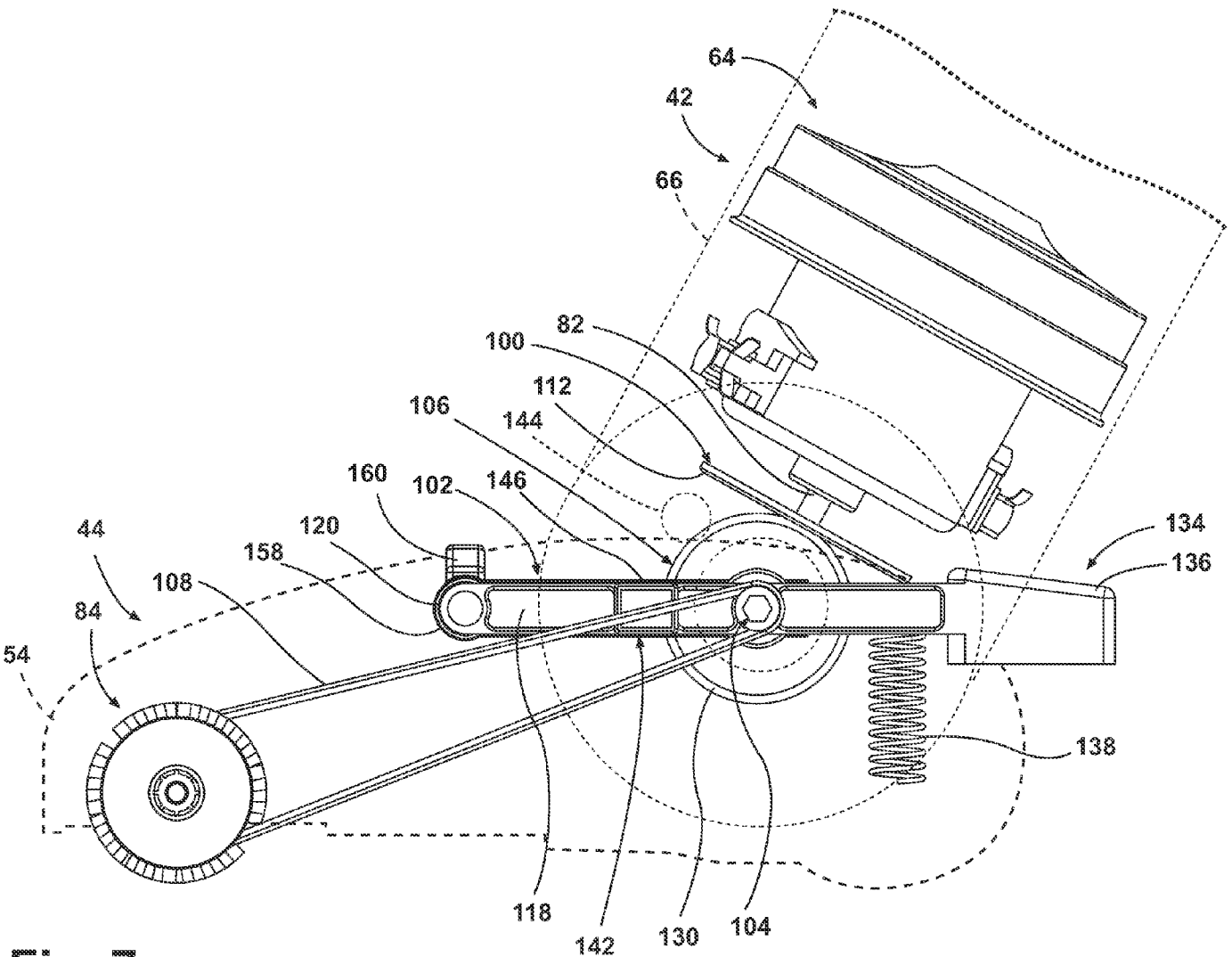
FIG. 7 is a side view of the base assembly from FIG. 3, with an agitator drive assembly for an agitator shown in an engaged position.
Figure 8:
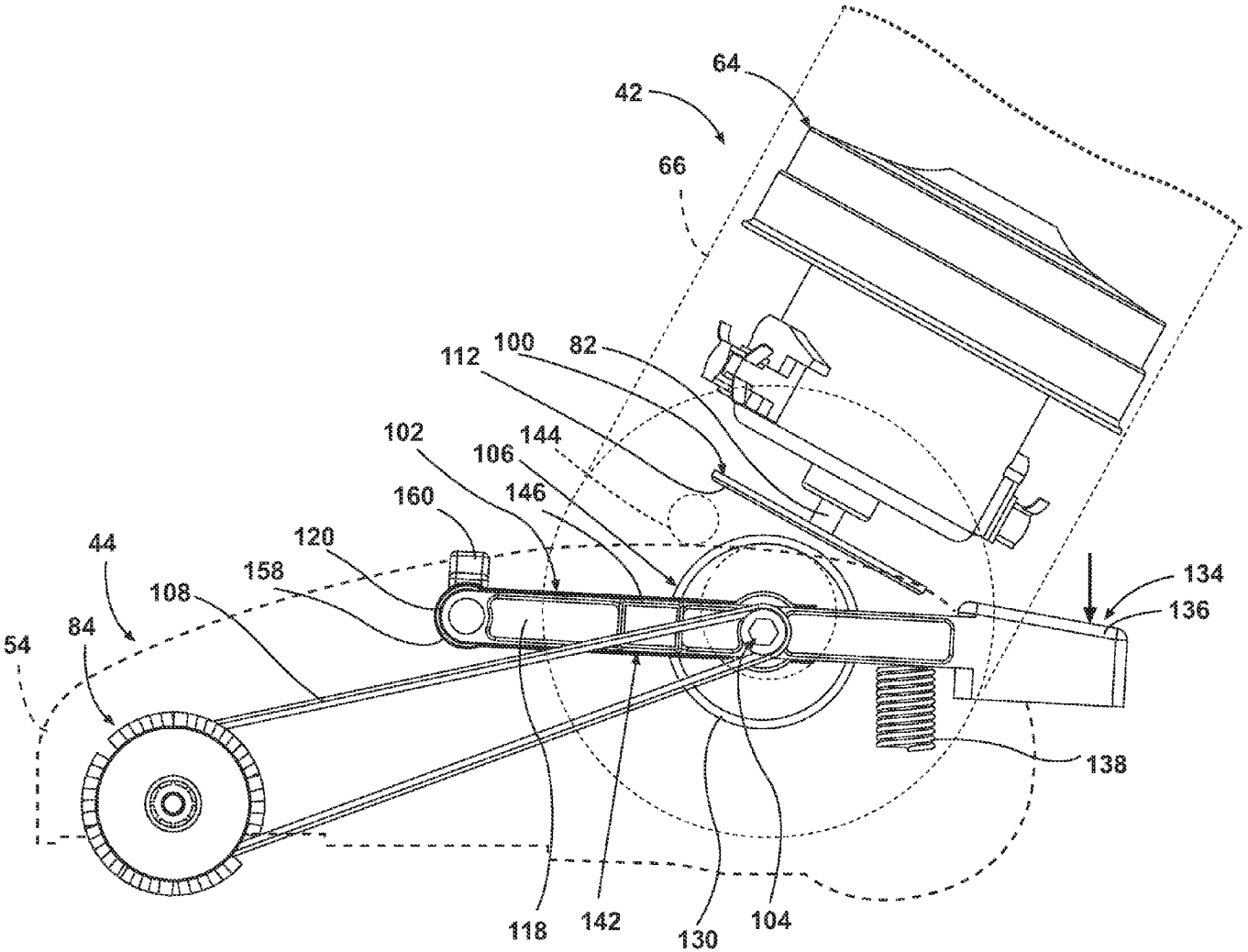
FIG. 8 is a side view similar to FIG. 7, with the agitator drive assembly shown in a disengaged position.

The agitator drive assembly 98 can further comprise a drive disengager for selectively interrupting the transmission of drive force to the agitator 84. The drive disengager can comprise a user-operable actuator 134 for selectively moving the agitator drive assembly 98 from an engaged position shown in FIG. 7, in which the clutch disk 106 engages the drive surface 110 of the drive disk 100, to a disengaged position shown in FIG. 8, in which the clutch disk 106 is spaced from the drive surface 110 of the drive disk 100. The actuator 134 can be provided on the carriage 102 as a foot pedal 136 on the exterior of the base housing 54 which the user typically engages with a foot. The second carriage arm 118 can comprise a portion which extends exteriorly of the base housing 54 to couple the foot pedal 136 with the carriage 102. By pressing downwardly on the foot pedal 136, as shown in FIG. 8, the carriage 102 is rotated about the pivot axis 122 defined by the pivot shaft 120, which causes separation of the clutch disk 106 from the drive disk 100, removes energy to the belt 108, and stops the agitator 84 from rotating.

The agitator drive assembly 98 can further comprise a biasing element for biasing the carriage 102 to the engaged position. As shown herein, the biasing element can comprise a spring 138 positioned between the second carriage arm 118 and the base housing 54. The spring 138 creates pressure between the clutch disk 106 and the drive disk 100. Depressing the foot pedal 136 compresses the spring 138, as shown in FIG. 8. Upon releasing the foot pedal 136, the spring 138 forces the second carriage arm 118 upwardly, thereby pivoting the carriage 102 about the pivot axis 122 back to the engaged position (FIG. 7).

The agitator drive assembly 98 can further comprise a latch 140 for maintaining the carriage 102 in the disengaged position. The latch 140 can be configured to secure the actuator 134 in the depressed orientation shown in FIG. 8. The latch 140 can be a commonly-known push-push latch, whereby pressing the foot pedal 136 once engages the latch 140 and pressing the foot pedal 136 a second time releases the latch 140.

Figure 9:
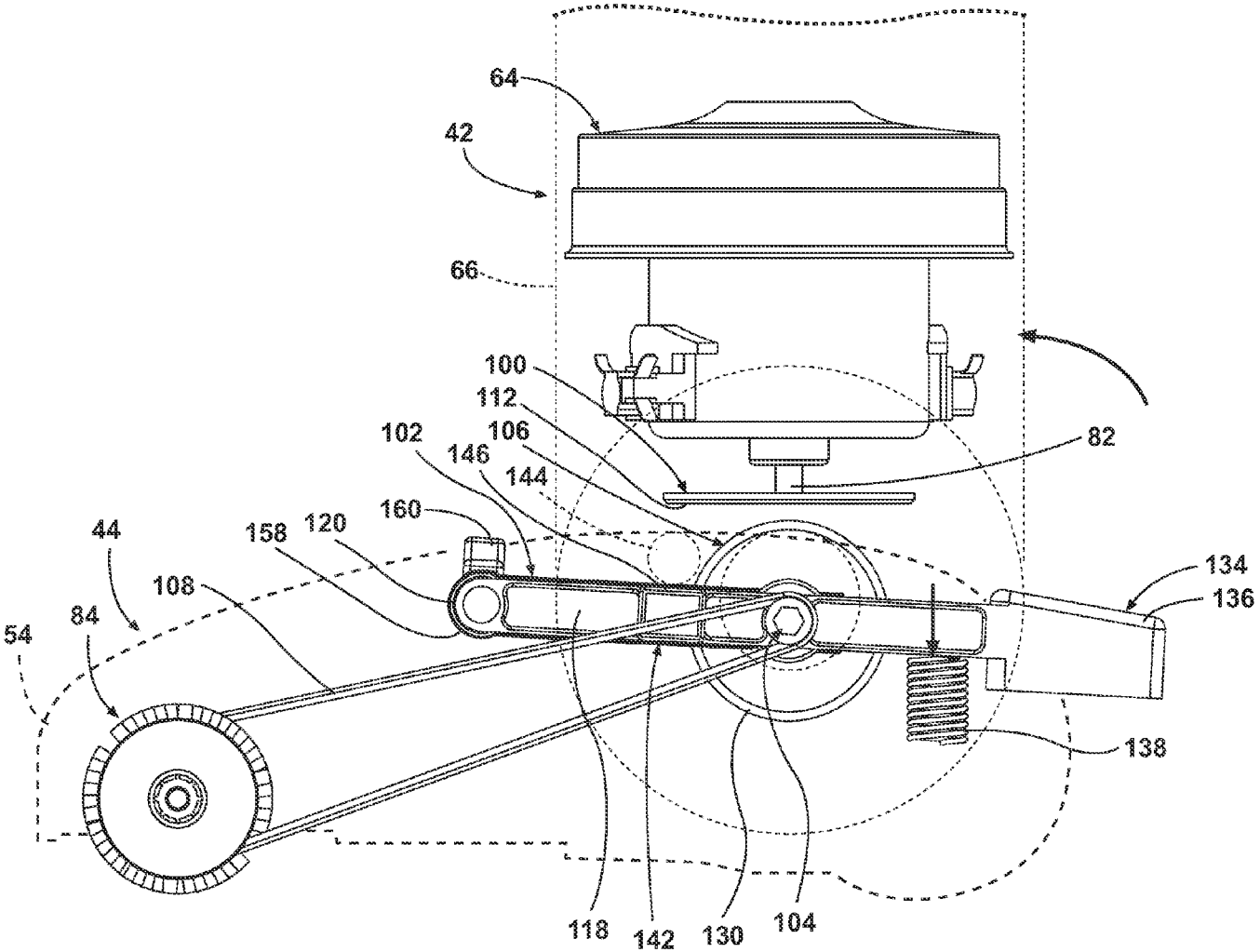
FIG. 9 is a side view similar to FIG. 7, with the upright assembly shown in a stored position and the agitator drive assembly shown in a disengaged position.

The drive disengager can further be configured to automatically interrupt the transmission of drive force to the agitator 84 when the upright assembly 12 is placed in an upright or stored position, as shown in FIG. 9. The drive disengager can include an interface 142 which is selectively engaged by a corresponding protrusion 144 (see also FIG. 4) on the upright assembly 12. As shown herein, the interface 142 can comprise an extension having an upper surface 146 on the second carriage arm 118. When the upright assembly 12 is in the lowered or "use" position shown in FIGS. 7 and 8, the protrusion 144 does not engage the interface 142. When the upright assembly 12 is moved to the upright or "stored" position, as shown in FIG. 9, the protrusion 144 engages the interface 142 and presses downwardly on the upper surface 146, which gradually forces the second carriage arm 118, and thus the entire carriage 102, to rotate downwardly about the pivot axis 122 to the disengaged position.

Figure 10:
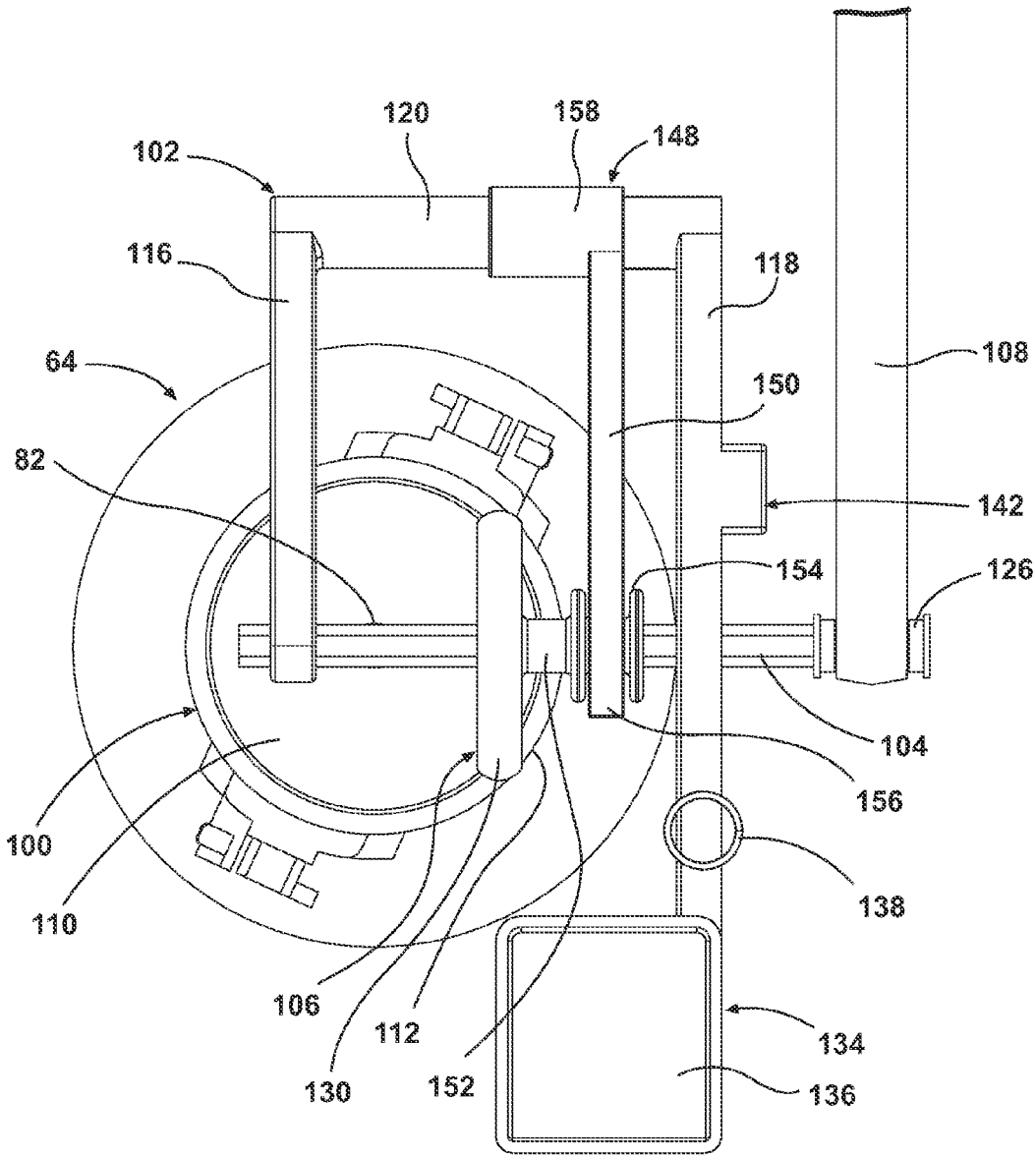
FIGS. 10-11 are bottom views of the agitator drive assembly from FIG. 5, illustrating the movement of a speed selector for adjusting the relative speed of rotation of the agitator.
Figure 11:
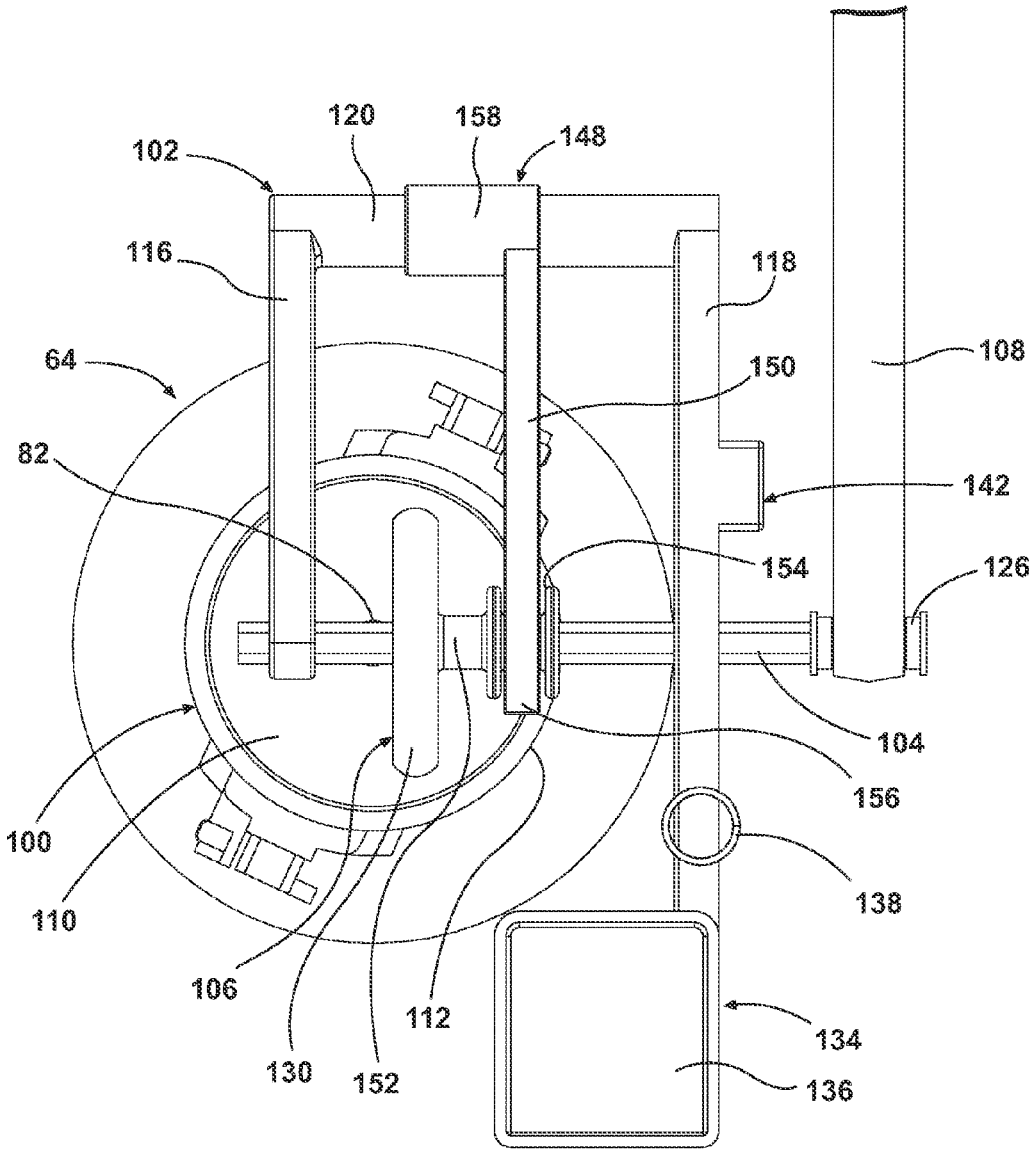

FIGS. 10-11 are bottom views of the agitator drive assembly 98. The agitator drive assembly 98 can further comprise a speed selector 148 for adjusting the relative speed of rotation of the agitator 84. As shown herein, the speed selector 148 can be coupled with the clutch disk 106, and can be configured to adjust the position of the clutch disk 106 relative to the diameter of the drive disk 100. FIG. 10 illustrates the clutch disk 106 at an outer most periphery of the drive disk 100 while FIG. 11 illustrates the clutch disk 106 at an inner most location near the center of the drive disk 100 nearest the motor shaft 82.

The speed selector 148 comprises a selector arm 150 with a first end mounted to the clutch disk 106 and a second end mounted to a fixed feature on the base housing 54. The second end of the selector arm 150 is mounted to the pivot shaft 120, although other mounting locations on the base housing 54 are possible. The clutch disk 106 can be provided with a shaft 152 extending laterally from a side surface of the hub 128 and a neck portion 154 provided on the shaft 152. This first end of the selector arm 150 can comprise an open collar 156 which receives the neck portion 154 to fix the selector arm 150 to the clutch disk 106.

The second end can comprise an annular collar 158 that is slidingly received on the pivot shaft 120, such that the selector arm 150 can slide longitudinally relative to the pivot shaft 120 along the pivot axis 122. An actuator 160 affixed to the annular collar 158 can be engaged by the user to selectively locate the position of the annular collar 158 on the pivot shaft 120. The actuator 160 can comprise a tab configured to project exteriorly of the base housing 54 for providing a place to grip the actuator 160 to move the selector arm 150. The base housing 54 can be provided with a slot which permits the actuator 160 to slide relative to the base housing 54. Indicia may be provided on the base housing 54 adjacent the slot to indicate the setting of the speed selector 148. The indicia can correspond directly to agitator speed, or can correlate agitator speed with different floor types, i.e. bare floor, low carpet pile, high carpet pile, etc.

FIGS. 10-11 illustrate the movement of the speed selector 148 between two possible positions for adjusting the relative speed of rotation of the agitator 84. As the clutch disk 106 is moved along the drive surface 110 of the drive disk 100, the speed of the clutch disk 106, and correspondingly the speed of the agitator 84, changes, thus providing a variable speed brush control. By gripping the actuator 160 (FIG. 3), the user can slide the selector arm 150 laterally so that the clutch disk 106 changes contact position with the drive disk 100. When the clutch disk 106 is positioned near the outer perimeter 112 of the drive disk 100, as shown in FIG. 10, the clutch disk 106 will rotate at the fastest rate, thereby increasing the rotational speed of the agitator 84 to its maximum rotational rate. When the clutch disk 106 is positioned near the center of the drive disk 100 nearer the motor shaft 82, as shown in FIG. 11, the clutch disk 106 will rotate more slowly, thereby decreasing the rotational speed of the agitator 84 to its lowest rotational rate.

The speed selector 148 can be configured to have a limited number of discrete positions for the clutch disk 106 relative to the flywheel 110, thereby providing discretely-adjustable speed control. This function can be accomplished by providing detents in the base housing 54 that are progressively engaged by the selector arm 150 or actuator 160. Alternatively, the speed selector 148 can be configured to place the clutch disk 106 at any location between the center and outer perimeter of the drive disk 100, thereby providing infinitely-adjustable speed control between a maximum and minimum speed value. This can be accomplished by allowing the selector arm 150 or actuator 160 to slide along the pivot shaft 120 without interruption.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention which is defined in the appended claims.

What is claimed is:

1. A vacuum cleaner comprising:

a base assembly having a housing, a suction nozzle, and an agitator rotatably mounted to the housing;

a motor comprising a motor shaft;

an agitator drive assembly between the motor shaft and the agitator for selectively driving the agitator, and comprising:

a drive disk mounted to the motor shaft for rotation therewith and having a drive face;

a driven disk selectively coupled with the drive disk for rotational contact with the drive face of the drive disk; and a drive coupling between the driven disk and the agitator;

a shaft pivotally coupled to the housing for rotation about an axis defined by the shaft;

an actuator operably coupling the driven disk with the shaft to move the driven disk about the axis defined by the shaft between an engaging position in which the driven disk is in rotational contact with the drive face and a disengaging position in which the driven disk is disengaged from rotational contact with the drive face; and a speed selector assembly slidably coupling the driven disk to the shaft to allow the driven disk to slide substantially parallel to the axis defined by the shaft for lateral movement across the face of the drive disk to change the relative speed of the agitator.

2. The vacuum cleaner according to claim 1 wherein the actuator comprises a first portion positioned exterior of the housing for user access and a second portion positioned interior of the housing.

3. The vacuum cleaner according to claim 2 wherein the driven disk is rotatably mounted to the second portion.

4. The vacuum cleaner according to claim 3 wherein the first portion comprises a foot pedal.

5. The vacuum cleaner according to claim 1 and further comprising a biasing member for biasing the actuator to the engaging position.

6. The vacuum cleaner according to claim 5 and further comprising a latch for the actuator for maintaining the actuator in the disengaging position.

7. The vacuum cleaner according to claim 1, wherein the speed selector assembly further comprises a speed selector actuator coupled to the driven disk for selectively moving the driven disk laterally across the face of the drive disk.

8. The vacuum cleaner according to claim 7 wherein a portion of the speed selector actuator extends exteriorly of the housing.

9. The vacuum cleaner according to claim 8 wherein the speed selector actuator is slidingly coupled to the shaft.

10. The vacuum cleaner according to claim 1, and further comprising:

an upright assembly pivotally mounted to the base assembly for movement between an upright position and a lowered use position, and comprising a handle for facilitating movement of the vacuum cleaner by a user; and a drive disengager configured to automatically uncouple the driven disk from the drive disk when the upright assembly is moved to the upright position.

11. The vacuum cleaner according to claim 1, wherein the drive disk comprises a flywheel.

12. The vacuum cleaner according to claim 1, wherein the drive coupling comprises a belt.

13. The vacuum cleaner according to claim 12, wherein the agitator drive assembly further comprises a drive pulley coupled with the driven disk and a driven pulley coupled with the agitator, wherein the belt couples the drive pulley with the driven pulley.

14. The vacuum cleaner according to claim 1 wherein the actuator comprises a vertically-moveable foot pedal.

15. The vacuum cleaner according to claim 14 and further comprising an arm extending between the shaft and the foot pedal.

16. The vacuum cleaner according to claim 15 and further comprising a drive axle coupled with the arm, wherein the driven disk is mounted on the drive axle.

17. The vacuum cleaner according to claim 16, wherein the drive coupling comprises a belt extending between the drive axle and the agitator.

18. The vacuum cleaner according to claim 14 wherein the drive face defines a plane that is perpendicular to an axis of rotation of the motor shaft, and the driven disk moves substantially vertically relative to the drive face.

19. The vacuum cleaner according to claim 1, wherein the speed selector assembly comprises an arm extending from the shaft to the driven disk.

20. The vacuum cleaner according to claim 19, wherein the arm is slidably coupled with the shaft for sliding movement along the shaft relative to the axis defined by the shaft.

* * * * *